US010354629B2

(12) United States Patent
Hamano et al.

(10) Patent No.: US 10,354,629 B2
(45) Date of Patent: Jul. 16, 2019

(54) SOUND CONTROL DEVICE, SOUND CONTROL METHOD, AND SOUND CONTROL PROGRAM

(71) Applicant: YAMAHA CORPORATION, Hamamatsu-shi (JP)

(72) Inventors: Keizo Hamano, Hamamatsu (JP); Yoshitomo Ota, Hamamatsu (JP); Kazuki Kashiwase, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/705,696

(22) Filed: Sep. 15, 2017

(65) Prior Publication Data

US 2018/0005617 A1 Jan. 4, 2018

Related U.S. Application Data

(63) Continuation of application No. PCT/JP2016/058490, filed on Mar. 17, 2016.

(30) Foreign Application Priority Data

Mar. 20, 2015 (JP) ..... 2015-057946

(51) Int. Cl.
*G10H 1/02* (2006.01)
*G10H 1/00* (2006.01)
(Continued)

(52) U.S. Cl.
CPC ..... *G10H 1/02* (2013.01); *G10H 1/00* (2013.01); *G10H 1/0025* (2013.01); *G10L 13/00* (2013.01);
(Continued)

(58) Field of Classification Search
CPC ..... G10H 1/02
(Continued)

(56) References Cited

U.S. PATENT DOCUMENTS 5,998,725 A * 12/1999 Ohta ..... 84/609
6,424,944 B1 * 7/2002 Hikawa ..... G10L 13/08 704/258
(Continued)

FOREIGN PATENT DOCUMENTS

EP 2680254 A2 1/2014
EP 2779159 A1 9/2014
(Continued)

OTHER PUBLICATIONS

International Search Report issued in International Application No. PCT/JP2016/058490 dated May 17, 2016. English translation provided.
(Continued)

*Primary Examiner* — David S Warren
(74) *Attorney, Agent, or Firm* — Rossi, Kimms & McDowell LLP

(57) ABSTRACT

A sound control device includes: a reception unit that receives a start instruction indicating a start of output of a sound; a reading unit that reads a control parameter that determines an output mode of the sound, in response to the start instruction being received; and a control unit that causes the sound to be output in a mode according to the read control parameter.

18 Claims, 13 Drawing Sheets

(51) Int. Cl.
*G10L 13/00* (2006.01)
*G10L 13/10* (2013.01)
*G10L 13/033* (2013.01)

(52) U.S. Cl.
CPC ..... *G10L 13/033* (2013.01); *G10L 13/10* (2013.01); *G10H 2210/165* (2013.01)

(58) Field of Classification Search
USPC ..... 84/609
See application file for complete search history.

(56) References Cited

U.S. PATENT DOCUMENTS 6,992,245 B2 * 1/2006 Kenmochi ..... G10H 7/002 704/E13.002
7,124,084 B2 * 10/2006 Kayama ..... G10L 13/02 704/267
7,135,636 B2 * 11/2006 Kemmochi ..... G10H 7/00 84/622
7,173,178 B2 * 2/2007 Kobayashi ..... G10H 5/005 704/268
7,183,482 B2 * 2/2007 Kobayashi ..... G10H 1/0066 704/268
7,189,915 B2 * 3/2007 Kobayashi ..... G10H 1/0066 704/268
7,241,947 B2 * 7/2007 Kobayashi ..... G10L 13/033 704/268
7,249,022 B2 * 7/2007 Kayama ..... G10L 13/02 704/267
7,383,186 B2 * 6/2008 Kemmochi ..... G10H 5/00 704/258
8,244,546 B2 * 8/2012 Nakano ..... G10H 1/366 434/318
9,009,052 B2 * 4/2015 Nakano ..... G10L 13/033 704/268
9,012,756 B1 * 4/2015 Goldman ..... G10H 1/0066 84/610
9,595,256 B2 * 3/2017 Nakano ..... G10L 13/10
10,002,604 B2 * 6/2018 Kayama ..... G10L 13/08
2003/0009344 A1 * 1/2003 Kayama ..... G10L 13/02 704/500
2003/0159568 A1 * 8/2003 Kemmochi ..... G10H 7/00 84/626
2003/0221542 A1 * 12/2003 Kenmochi ..... G10H 7/002 84/616
2004/0099126 A1 * 5/2004 Kawashima ..... G10H 1/0058 84/609
2004/0186720 A1 * 9/2004 Kemmochi ..... G10H 5/00 704/258
2004/0231499 A1 * 11/2004 Kobayashi ..... G10H 5/005 84/645
2006/0085196 A1 * 4/2006 Kayama ..... G10L 13/02 704/267
2006/0085197 A1 * 4/2006 Kayama ..... G10L 13/02 704/267
2006/0085198 A1 * 4/2006 Kayama ..... G10L 13/02 704/267
2006/0156909 A1 * 7/2006 Kobayashi ..... G10H 1/0066 84/645
2006/0185504 A1 * 8/2006 Kobayashi ..... G10H 1/0066 84/645
2009/0306987 A1 * 12/2009 Nakano ..... G10H 1/366 704/260
2013/0151256 A1 * 6/2013 Nakano ..... G10L 13/033 704/268
2014/0136207 A1 * 5/2014 Kayama ..... G10L 13/08 704/258
2014/0165820 A1 * 6/2014 Van Buskirk ..... G10H 1/125 84/661
2015/0310850 A1 * 10/2015 Nakano ..... G10L 13/10 704/258
2016/0034446 A1 * 2/2016 Yamamoto ..... G10H 7/008 704/9
2016/0111083 A1 * 4/2016 Iriyama ..... G10L 13/0335 704/267
2017/0169806 A1 * 6/2017 Hamano ..... G10G 1/00
2018/0005617 A1 * 1/2018 Hamano ..... G10H 1/00
2018/0018957 A1 * 1/2018 Hamano ..... G10L 13/027
2018/0122346 A1 * 5/2018 Kayama ..... G10H 1/02
2018/0166064 A1 * 6/2018 Saino ..... G10L 13/00
2018/0174561 A1 * 6/2018 Nariyama ..... G10H 1/361
2018/0204588 A1 * 7/2018 Nariyama ..... G10L 25/51
2018/0240448 A1 * 8/2018 Nariyama ..... G10H 1/366

FOREIGN PATENT DOCUMENTS

JP H04349497 A 12/1992
JP H0895588 A 4/1996
JP H1031496 A 2/1998
JP 2000330584 A 11/2000
JP 2002202788 A 7/2002
JP 2013148864 A 8/2013
JP 2013152337 A 8/2013
JP 2014089475 A 5/2014
JP 2014098801 A 5/2014

OTHER PUBLICATIONS

Written Opinion issued in International Application No. PCT/JP2016/058490 dated May 17, 2016.
International Preliminary Report on Patentability issued in International Application No. PCT/JP2016/058490 dated Jun. 6, 2017. English translation provided.
Yamaha Corporation, VOCALOID Effective Utilization Manual "Vocaloid Editor Utilization Method" pp. 1-7. Copyright 2004. Partial English translation provided.
Partial Supplementary European Search Report issued in European Appln. No. 16768618.7 dated Jul. 4, 2018.

* cited by examiner

50

50a 50b 50c

| SYLLABLE INFORMATION | SOUND GENERATION CONTROL PARAMETER TYPE | VALUE v1 | VALUE v2 | VALUE v3 |
|---|---|---|---|---|
| c1 | PARAMETER a | | | |
| | PARAMETER b | | | |
| c2 | PARAMETER b | | | |
| | PARAMETER c | | | |
| | PARAMETER d | | | |
| c3 | – | – | – | – |
| c41 | ⋮ | ⋮ | ⋮ | ⋮ |

| SYLLABLE INFORMATION | SOUND GENERATION CONTROL PARAMETER TYPE | VALUE v1 | VALUE v2 | VALUE v3 |
|---|---|---|---|---|
| c1 | PARAMETER a | | | |
| | PARAMETER b | | | |
| c2 | PARAMETER b | | | |
| | PARAMETER c | | | |
| | PARAMETER d | | | |
| c3 | – | – | – | – |
| c41 | ⋮ | ⋮ | ⋮ | ⋮ |

FIG. 12

50

50c

50b

| ORDER | | SOUND GENERATION CONTROL PARAMETER TYPE | VALUE v1 | VALUE v2 | VALUE v3 |
|---|---|---|---|---|---|
| 1 | FIRST CONTROL PARAMETER INFORMATION | PARAMETER a | | | |
| | | PARAMETER b | | | |
| 2 | SECOND CONTROL PARAMETER INFORMATION | PARAMETER b | | | |
| | | PARAMETER c | | | |
| | | PARAMETER d | | | |
| | | — | — | — | — |
| ⋮ | ⋮ | ⋮ | ⋮ | ⋮ | ⋮ |
| 45 | 45TH CONTROL PARAMETER INFORMATION | PARAMETER c | | | |
| | | PARAMETER d | | | |
| ⋮ | ⋮ | ⋮ | ⋮ | ⋮ | ⋮ |
| n | nTH CONTROL PARAMETER INFORMATION | | | | |

FIG. 13

50

50c

50b

| PITCH | | SOUND GENERATION CONTROL PARAMETER TYPE | VALUE v1 | VALUE v2 | VALUE v3 |
|---|---|---|---|---|---|
| A5 | FIRST CONTROL PARAMETER INFORMATION | PARAMETER a | | | |
| | | PARAMETER b | | | |
| B5 | SECOND CONTROL PARAMETER INFORMATION | PARAMETER b | | | |
| | | PARAMETER c | | | |
| | | PARAMETER d | | | |
| | | — | — | — | — |
| | ⋮ | ⋮ | ⋮ | ⋮ | ⋮ |
| | 45TH CONTROL PARAMETER INFORMATION | PARAMETER c | | | |
| | | PARAMETER d | | | |
| | ⋮ | ⋮ | ⋮ | ⋮ | ⋮ |
| | nTH CONTROL PARAMETER INFORMATION | | | | |

50

50b

50c

| SYLLABLE | | SOUND GENERATION CONTROL PARAMETER TYPE | VALUE v1 | VALUE v2 | VALUE v3 |
|---|---|---|---|---|---|
| a | FIRST CONTROL PARAMETER INFORMATION | PARAMETER a | | | |
| | | PARAMETER b | | | |
| i | SECOND CONTROL PARAMETER INFORMATION | PARAMETER b | | | |
| | | PARAMETER c | | | |
| | | PARAMETER d | | | |
| | | — | — | — | — |
| | ⋮ | ⋮ | ⋮ | ⋮ | ⋮ |
| ro | 45TH CONTROL PARAMETER INFORMATION | PARAMETER c | | | |
| | | PARAMETER d | | | |
| | ⋮ | ⋮ | ⋮ | ⋮ | ⋮ |
| | nTH CONTROL PARAMETER INFORMATION | | | | |

SOUND CONTROL DEVICE, SOUND CONTROL METHOD, AND SOUND CONTROL PROGRAM

CROSS-REFERENCE TO RELATED APPLICATIONS

The present application is a continuation application of International Application No. PCT/JP2016/058490, filed Mar. 17, 2016, which claims priority to Japanese Patent Application No. 2015-057946, filed Mar. 20, 2015. The contents of these applications are incorporated herein by reference.

BACKGROUND OF THE INVENTION

Field of the Invention

The present invention relates to a sound control device, a sound control method, and a sound control program that can easily perform expressive sounds.

Description of Related Art

Japanese Unexamined Patent Application First Publication No. 2002-202788 (hereinafter Patent document 1) discloses a singing sound synthesizing apparatus that performs singing sound synthesis on the basis of performance data input in real time. This singing sound synthesizing apparatus forms a singing synthesis score based on performance data received from a musical instrument digital interface (MIDI) device, and synthesizes singing on the basis of the score. The singing synthesis score includes phoneme tracks, transition tracks, and vibrato tracks. Volume control and vibrato control are performed according to the operation of the MIDI device.

VOCALOID Effective Utilization Manual "VOCALOID EDITOR Utilization Method" [online], [Search February 27, Heisei 27], Internet <http://www.crypton.co.jp/mp/pages/download/pdf/vocaloid_master_01.pdf> (hereinafter Non-patent document 1) discloses a vocal track creation software. In the vocal track creation software, notes and lyrics are input, and the lyrics is caused to be sung following along the pitch of the note. Non-patent document 1 describes that a number of parameters for adjusting the expression and intonation of the voice, and changes in voice quality and timbre are provided, so that fine nuances and intonation are attached to the singing sound.

When performing singing sound synthesis by performing in real-time, there are limitations on the number of parameters that can be operated during the performance. Therefore, there is a problem in that it is difficult to control a large number of parameters as in the vocal track creation software described in Non-Patent Document 1, which allows singing by reproducing previously entered information.

SUMMARY OF THE INVENTION

An example of an object of the present invention is to provide a sound control device, a sound control method, and a sound control program that can easily perform expressive sounds.

A sound control device according to an aspect of the present invention includes: a reception unit that receives a start instruction indicating a start of output of a sound; a reading unit that reads a control parameter that determines an output mode of the sound, in response to the start instruction being received; and a control unit that causes the sound to be output in a mode according to the read control parameter.

A sound control method according to an aspect of the present invention includes: receiving a start instruction indicating a start of output of a sound; reading a control parameter that determines an output mode of the sound, in response to the start instruction being received; and causing the sound to be output in a mode according to the read control parameter.

A sound control program according to an aspect of the present invention causes a computer to execute: receiving a start instruction indicating a start of output of a sound; reading a control parameter that determines an output mode of the sound, in response to the start instruction being received; and causing the sound to be output in a mode according to the read control parameter.

In a sound generating apparatus according to an embodiment of the present invention, a sound is output in a sound generation mode according to a read control parameter, in accordance with the start instruction. For this reason, it is easy to play expressive sounds.

BRIEF DESCRIPTION OF THE DRAWINGS

FIG. 12 is a diagram showing a modified example of the lyrics information table according to the third embodiment of the present invention.

FIG. 13 is a diagram showing a modified example of the lyrics information table according to the third embodiment of the present invention.

EMBODIMENTS FOR CARRYING OUT THE INVENTION

Figure 1:
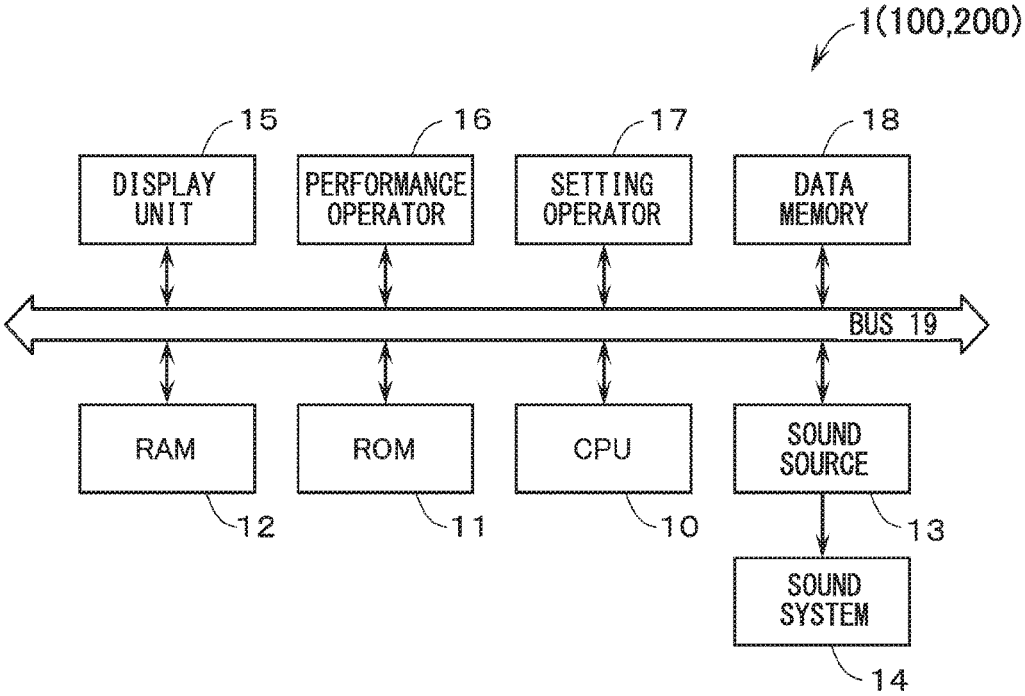
FIG. 1 is a functional block diagram showing a hardware configuration of a sound generating apparatus according to an embodiment of the present invention.

FIG. 1 is a functional block diagram showing a hardware configuration of a sound generating apparatus according to an embodiment of the present invention.

A sound generating apparatus 1 according to the embodiment of the present invention shown in FIG. 1 includes a CPU (Central Processing Unit) 10, a ROM (Read Only Memory) 11, a RAM (Random Access Memory) 12, a sound source 13, a sound system 14, a display unit (display) 15, a performance operator 16, a setting operator 17, a data memory 18, and a bus 19.

A sound control device may correspond to the sound generating apparatus 1 (100, 200). A reception unit, a reading unit, a control unit, a storage unit, and an operator of this sound control device, may each correspond to at least one of these configurations of the sound generating apparatus 1. For example, the reception unit may correspond to at least one of the CPU 10 and the performance operator 16. The reading unit may correspond to the CPU 10. The control unit may correspond to at least one of the CPU 10, the sound source 13, and the sound system 14. The storage unit may correspond to the data memory 18. The operator may correspond to the performance operator 16.

The CPU 10 is a central processing unit that controls the whole sound generating apparatus 1 according to the embodiment of the present invention. The ROM (Read Only Memory) 11 is a nonvolatile memory in which a control program and various data are stored. The RAM 12 is a volatile memory used for a work area of the CPU 10 and for the various buffers. The data memory 18 stores syllable information including text data in which lyrics are divided up into syllables, and a phoneme database storing speech element data of singing sounds, and the like. The display unit 15 is a display unit including a liquid crystal display or the like on which the operating state and various setting screens and messages to the user are displayed. The performance operator 16 is a performance operator including a keyboard (see part (c) of FIG. 7) having a plurality of keys corresponding to different pitches. The performance operator 16 generates performance information such as key-on, key-off, pitch, and velocity. In the following, the performance controller may be referred to as a key in some cases. This performance information may be performance information of a MIDI message. The setting operator 17 is various setting operation elements such as operation knobs and operation buttons for setting the sound generating apparatus 1.

The sound source 13 has a plurality of sound generation channels. Under the control of the CPU 10, one sound generation channel is allocated to the sound source 13 according to the user's real-time performance using the performance operator 16. In the allocated sound generation channel, the sound source 13 reads out the speech element data corresponding to the performance from the data memory 18, and generates singing sound data. The sound system 14 converts the singing sound data generated by the sound source 13 into an analog signal by a digital-analog converter, amplifies the singing sound that is made into an analog signal, and outputs it to a speaker or the like. The bus 19 is a bus for transferring data between each part of the sound generating apparatus 1.

Figure 2A:
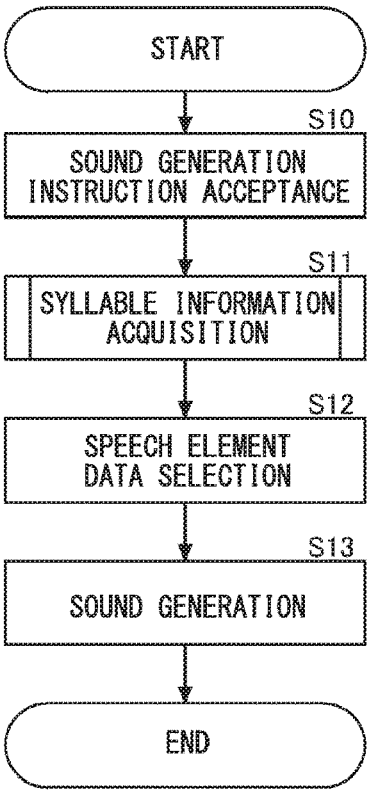
FIG. 2A is a flowchart of a key-on process executed by a sound generating apparatus according to a first embodiment of the present invention.
Figure 2B:
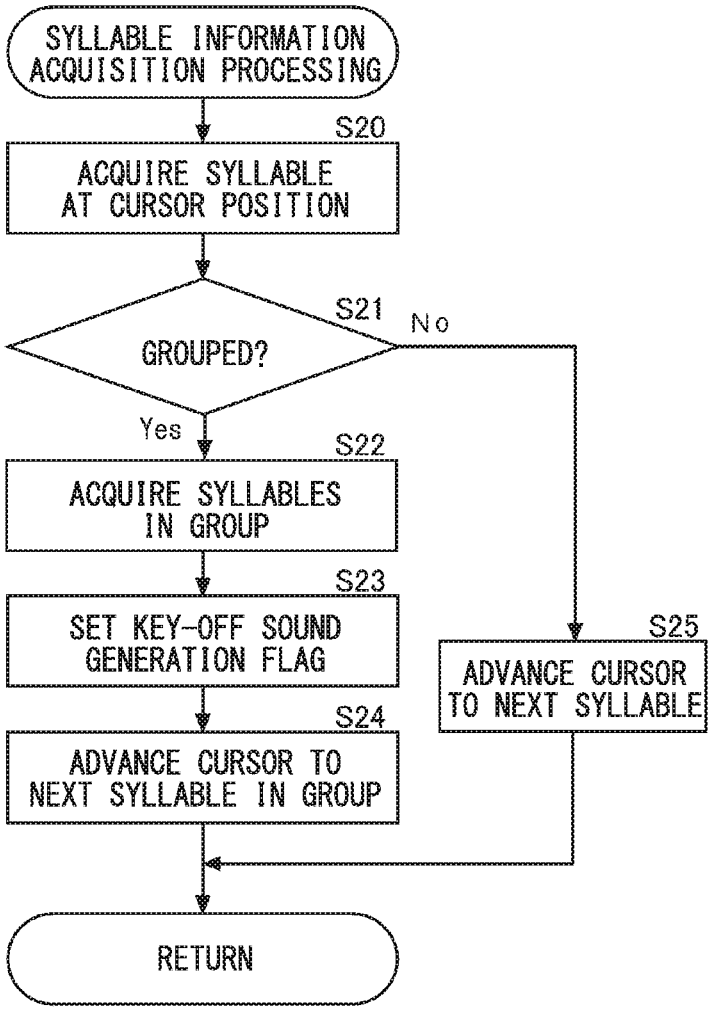
FIG. 2B is a flowchart of syllable information acquisition processing executed by the sound generating apparatus according to the first embodiment of the present invention.
Figure 3A:
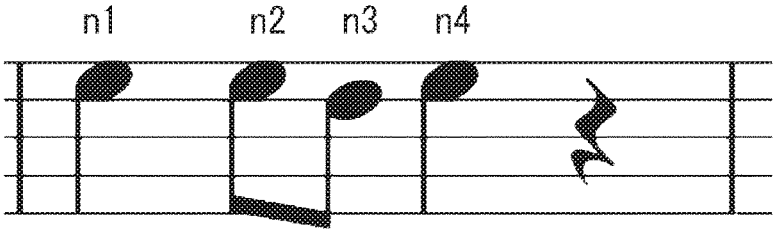
FIG. 3A is a diagram for explaining sound generation instruction acceptance processing to be processed by the sound generating apparatus according to the first embodiment of the present invention.
Figure 3B:
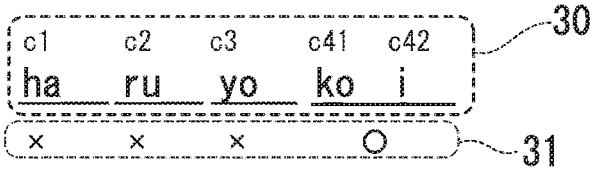
FIG. 3B is a diagram for explaining syllable information acquisition processing to be processed by the sound generating apparatus according to the first embodiment of the present invention.
Figure 3C:
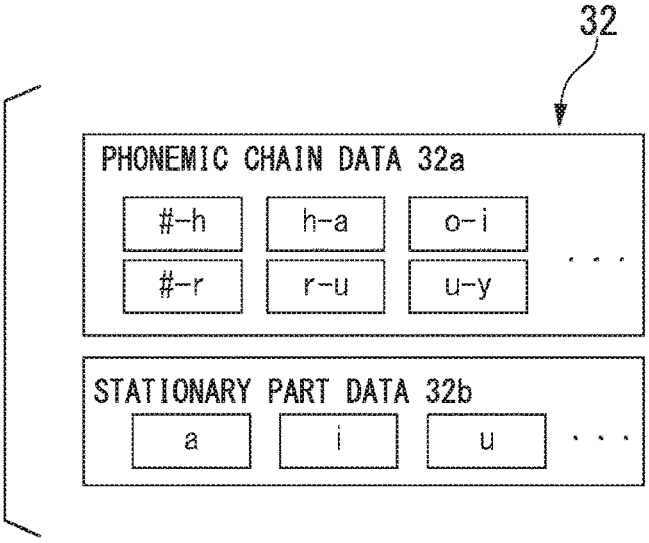
FIG. 3C is a diagram for explaining speech element data selection processing to be processed by the sound generating apparatus according to the first embodiment of the present invention.
Figure 4:
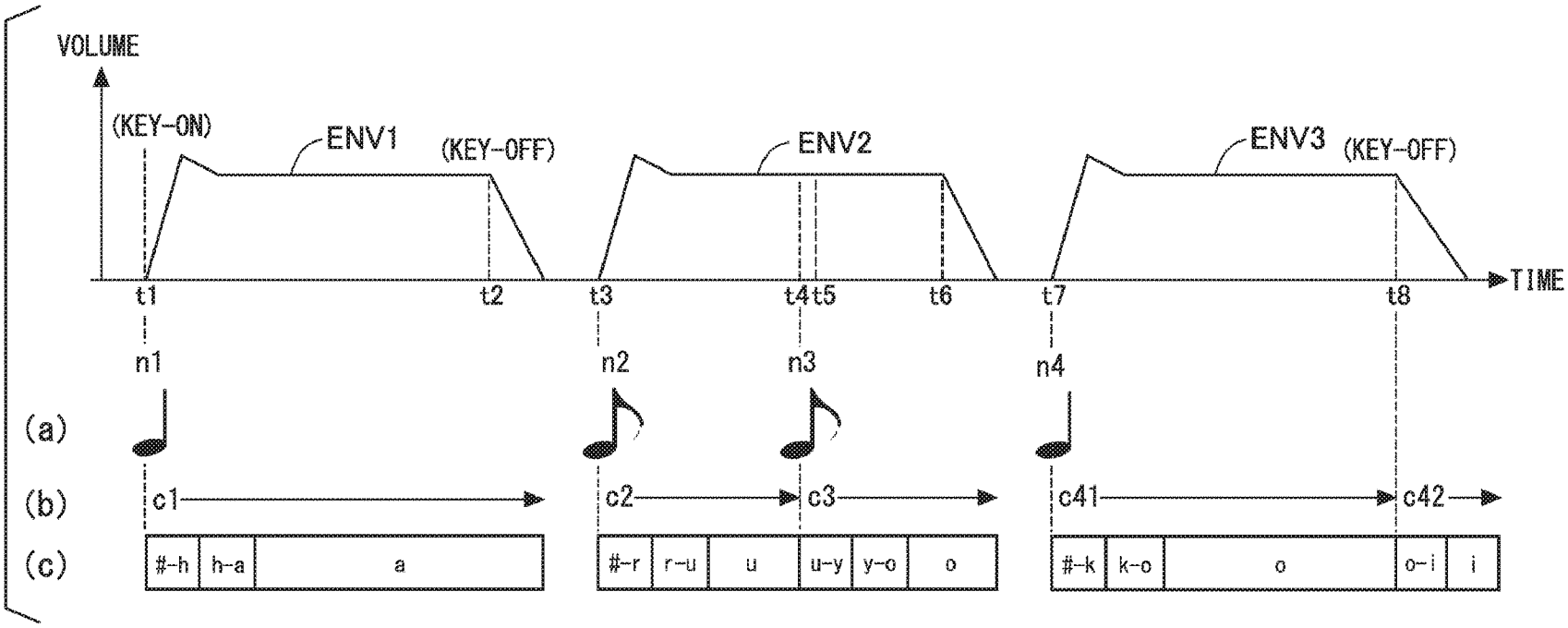
FIG. 4 is a timing chart showing the operation of the sound generating apparatus according to the first embodiment of the present invention.
Figure 5:
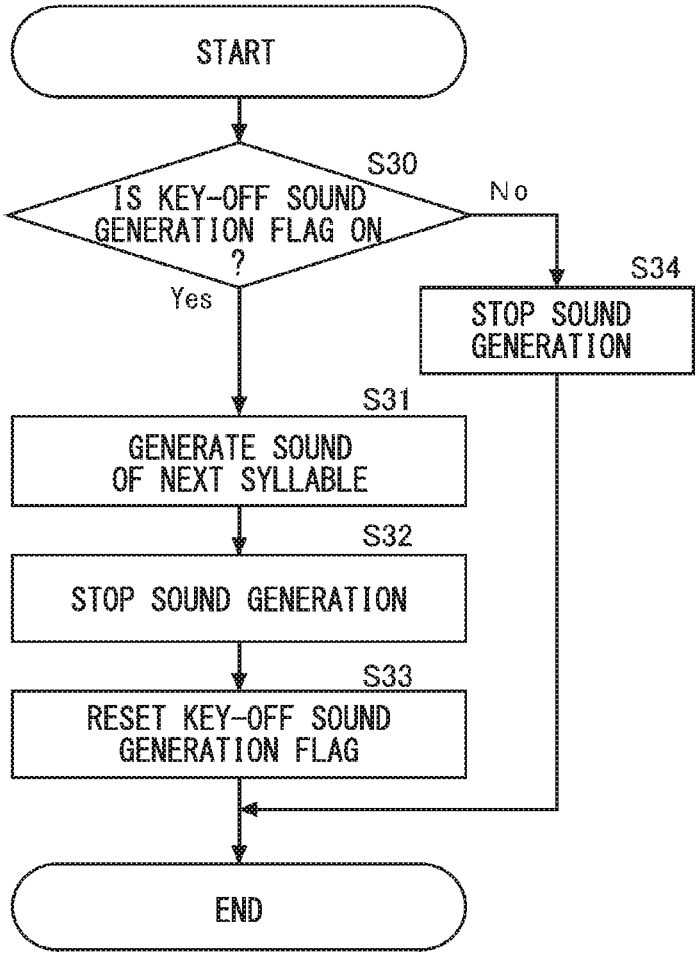
FIG. 5 is a flowchart of key-off processing executed by the sound generating apparatus according to the first embodiment of the present invention.

The sound generating apparatus 1 according to the first embodiment of the present invention will be described below. In the sound generating apparatus 1 of the first embodiment, when the performance operator 16 is keyed on, the key-on process of the flowchart shown in FIG. 2A is executed. FIG. 2B shows a flowchart of syllable information acquisition processing in this key-on process. FIG. 3A is an explanatory diagram of the sound generation receiving process in the key-on process. FIG. 3B is an explanatory diagram of syllable information acquisition processing. FIG. 3C is an explanatory diagram of speech element data selection processing. FIG. 4 is a timing chart showing the operation of the sound generating apparatus 1 of the first embodiment. FIG. 5 shows a flowchart of a key-off process executed when the performance operator 16 is keyed off in the sound generating apparatus 1 of the first embodiment.

In the sound generating apparatus 1 of the first embodiment, when the user performs in real-time, the performance is performed by operating the performance operator 16. The performance operator 16 may be a keyboard or the like. When the CPU 10 detects that the performance operator 16 is keyed on as the performance progresses, the key-on process shown in FIG. 2A is started. The CPU 10 executes the sound generation instruction acceptance processing of step S10 and the syllable information acquisition processing of step S11 in the key-on process. The sound source 13 executes the speech element data selection processing of step S12, and the sound generation processing of step S13 under the control of the CPU 10.

In step S10 of the key-on process, a sound generation instruction (an example of a start instruction) based on the key-on of the operated performance operator 16 is accepted. In this case, the CPU 10 receives performance information such as key-on timing, and pitch information and velocity of the operated performance operator 16. In the case where the user performs in real-time as shown in the musical score shown in FIG. 3A, when accepting the sound generation instruction of the first key-on n1, the CPU 10 receives the pitch information indicating the pitch of E5, and the velocity information corresponding to the key velocity.

Next, in step S11, syllable information acquisition processing for acquiring syllable information corresponding to key-on is performed. FIG. 2B is a flowchart showing details of syllable information acquisition processing. The syllable information acquisition processing is executed by the CPU 10. The CPU 10 acquires the syllable at the cursor position in step S20. In this case, specific lyrics are specified prior to the performance by the user. The specific lyrics are, for example, lyrics corresponding to the score shown in FIG. 3A and are stored in the data memory 18. Also, the cursor is placed at the first syllable of the text data. This text data is data obtained by delimiting the designated lyrics for each syllable. As a specific example, a case where the text data 30 is text data corresponding to the lyrics specified corresponding to the musical score shown in FIG. 3A will be described. In this case, the text data 30 is syllables c1 to c42 shown in FIG. 3B, that is, text data including five syllables of "ha", "ru", "yo", "ko", and "i". In the following, "ha", "ru", "yo", "ko", and "i" each indicate one letter of Japanese hiragana, being an example of syllables. In this case, the syllables "c1" to "c3" namely "ha", "ru", and "yo" are independent from each other. The syllables "ko" and "i" of c41 and c42 are grouped. Information indicating whether or not this grouping is performed is grouping information (an example of setting information) 31. The grouping information 31 is embedded in each syllable, or is associated with each syllable. In the grouping information 31, the symbol "x" indicates that the grouping is not performed, and the symbol "o" indicates that the grouping is performed. The grouping information 31 may be stored in the data memory 18. As shown in FIG. 3B, when accepting the sound generation instruction of the first key-on n1, the CPU 10 reads "ha" which is the first syllable c1 of the designated lyrics, from the data memory 18. At this time, the CPU 10 also reads the grouping information 31 embedded or associated with "ha" from the data memory 18. Next, the CPU 10 determines whether or not the syllable acquired in step S21 are grouped, from the grouping information 31 of the acquired syllable. In the case where the syllable acquired in step S20 is "ha" of c1, it is determined that the grouping is not made because the grouping information 31 is "x", and the process proceeds to step S25. In step S25, the CPU 10 advances the cursor to the next syllable of the text data 30, and the cursor is placed on "ru" of the second syllable c2. Upon completion of the process of step S25, the syllable information acquisition processing is terminated, and the process returns to step S12 of the key-on process.

FIG. 3C is a diagram for explaining the speech element data selection processing of step S12. The speech element data selection processing of step S12 is processing performed by the sound source 13 under the control of the CPU 10. The sound source 13 selects, from a phoneme database 32, speech element data that causes the obtained syllable to be generated. In the phoneme database 32, "phonemic chain data 32*a*" and "stationary partial data 32*b*" are stored. The phonemic chain data 32*a* is data of a phoneme piece when sound generation changes, corresponding to "consonants from silence (#)", "vowels from consonants", "consonants or vowels (of the next syllable) from vowels", and the like. The stationary part data 32*b* is the data of the phoneme piece when the sound generation of the vowel sound continues. In the case where the syllable acquired in response to accepting the sound generation instruction of the first key-on n1 is "ha" of c1, the sound source 13 selects from the phonemic chain data 32*a*, a speech element data "#-h" corresponding to "silence→consonant h", and a speech element data "h-a" corresponding to "consonant h→vowel a", and selects from the stationary partial data 32*b*, the speech element data "a" corresponding to "vowel a". Next, in step S13, the sound source 13 performs sound generation processing based on the speech element data selected in step S12 under the control of the CPU 10. As described above, when the speech element data is selected, then in the sound generation processing of step S13, the sound generation of the speech element data of "'#-h"→"h-a"→"a"' is sequentially performed by the sound source 13. As a result, sound generation of "ha" of syllable c1 is performed. At the time of sound generation, a singing sound of "ha" is generated with the volume corresponding to the velocity information at the pitch of E5 received at the time of receiving the sound generation instruction of key-on n1. When the sound generation processing of step S13 is completed, the key-on process is also terminated.

FIG. 4 shows the operation of this key-on process. Part (a) of FIG. 4 shows an operation of pressing a key. Part (b) of FIG. 4 shows the sound generation contents. Part (c) of FIG. 4 shows a speech element. At time t1, the CPU 10 accepts the sound generation instruction of the first key-on n1 (step S10). Next, the CPU 10 acquires the first syllable c1 and judges that the syllable c1 is not grouped with another syllable (step S11). Next, the sound source 13 selects the speech element data "#-h", "h-a", and "a" for generating the syllable c1 (step S12). Next, the envelope ENV1 of the volume corresponding to the velocity information of the key-on n1 is started, and the speech element data of "#-h"→"h-a"→"a" is generated at the pitch of E5 at the sound volume of the envelope ENV1 (step S13). As a result, a singing sound of "ha" is generated. The envelope ENV1 is an envelope of a sustain sound in which the sustain persists until key-off of the key-on n1. The speech element data of "a" is repeatedly reproduced until the key of key-on n1 is keyed off at time t2. Then, when the CPU 10 detects that the key-off (an example of the stop instruction) is made at the time t2, the key-off process shown in FIG. 5 is started. The processing of step S30 and step S33 of the key-off process is executed by the CPU 10. The processing of steps S31 and S32 is executed by the sound source 13 under the control of the CPU 10.

When the key-off process is started, it is judged in step S30 whether or not the key-off sound generation flag is on. The key-off sound generation flag is set when the acquired syllable is grouped. In the syllable information acquisition processing shown in FIG. 2A, the first syllable c1 is not grouped. Therefore, the CPU 10 determines that the key-off sound generation flag is not set (No in step S30), and the process proceeds to step S34. In step S34, under the control of the CPU 10, the sound source 13 performs mute processing, and as a result, the sound generation of the singing sound of "ha" is stopped. That is, the singing sound of "ha" is muted in the release curve of the envelope ENV1. Upon completion of the process of step S34, the key-off process is terminated.

When the performance operator 16 is operated as the real-time performance progresses, and the second key-on n2 is detected, the above-described key-on process is restarted and the key-on process described above is performed. The sound generation instruction acceptance processing of step S10 in the second key-on process will be described. In this processing, when accepting a sound generation instruction based on the key-on n2 of the operated performance operator 16, the CPU 10 receives the timing of the key-on n2, the pitch information indicating the pitch of E5, and the velocity information corresponding to the key velocity. In the syllable information acquisition processing of step S11, the CPU 10 reads out from the data memory 18, "ru" which is the second syllable c2 on which the cursor of the designated lyrics is placed. The grouping information 31 of the acquired syllable "ru" is "x". Therefore, the CPU 10 determines that it is not grouped, and advances the cursor to "yo" of c3 of the third syllable. In the speech element data selection processing of step S12, the sound source 13 selects from the phonemic chain data 32*a*, speech element data "#-r" corresponding to "silence→consonant r", and speech element data "r-u" corresponding to "consonant r→vowel u", and selects from the stationary part data 32*b*, the speech element data "u" corresponding to "vowel u". In the sound generation processing of step S13, the sound source 13 sequentially generates the speech element data of '"#-r"→"r-u"→"u"' under the control of the CPU 10. As a result, the syllable of "ru" of c2 is generated, and the key-on process is terminated.

When the performance operator 16 is operated with the progress of the real-time performance and the third key-on n3 is detected, the above-described key-on process is restarted and the key-on process described above is performed. This third key-on n3 is set to a legato to be keyed on before the second key-on n2 is keyed off. The sound generation instruction acceptance processing of step S10 in the third key-on process will be described. In this processing, when accepting a sound generation instruction based on the key-on n3 of the operated performance operator 16, the CPU 10 receives the timing of the key-on n3, the pitch information indicating a pitch of D5, and the velocity information corresponding to the key velocity. In the syllable information acquisition processing of step S11, the CPU 10 reads out from the data memory 18, "yo" which is the third syllable c3 on which the cursor of the designated lyrics is placed. The grouping information 31 of the acquired syllable "yo" is "x". Therefore, the CPU 10 determines that it is not grouped, and advances the cursor to "ko" of c41 of the fourth syllable. In the speech element data selection processing of step S12, the sound source 13 selects from the phonemic chain data 32*a*, the speech element data "u-y" corresponding to "vowel u→consonant y", and the speech element data "y-o" corresponding to "consonant y→vowel o", and selects from the stationary part data 32*b*, speech element data "o" corresponding to "vowel o" This is because the third key-on n3 is a legato so that sound from "ru" to "yo" is needs to be smoothly and continuously generated. In the sound generation processing of step S13, the sound source 13 sequentially generates the speech element data of '"u-y"→"y-o"→"o"' under the control of the CPU 10. As a result, syllable of "yo" of c3 which smoothly connects from "ru" of c2 is generated, and the key-on process is terminated.

FIG. 4 shows the operation of the second and third key-on process. At time t3, the CPU 10 accepts the sound generation instruction of the second key-on n2 (step S10). The CPU 10 acquires the next syllable c2 and judges that the syllable c2 is not grouped with another syllable (step S11). Next, the sound source 13 selects the speech element data "#-r", "r-u", and "u" for generating the syllable c2 (step S12). The sound source 13 starts the envelope ENV2 of the volume corresponding to the velocity information of the key-on n2 and generates the speech element data of '"#-r"→"r-u"→"u"' at the pitch of E5 and the volume of the envelope ENV2 (Step S13). As a result, the singing sound of "ru" is generated. The envelope ENV2 is the same as the envelope ENV1. The speech element data of "u" is repeatedly reproduced. At the time t4 before the key corresponding to the key-on n2 is keyed off, the sound generation instruction of the third key-on n3 is accepted (step S10). In response to the sound generation instruction, the CPU 10 acquires the next syllable c3 and judges that the syllable c3 is not grouped with another syllable (step S11). At time t4, since the third key-on n3 is a legato, the CPU 10 starts the key-off process shown in FIG. 5. In step S30 of the key-off process, "ru" which is the second syllable c2 is not grouped. Therefore, the CPU 10 determines that the key-off sound generation flag is not set (No in step S30), and the process proceeds to step S34. In step S34, the sound generation of the singing sound of "ru" is stopped. Upon completion of the process of step S34, the key-off process is terminated. This is due to the following reason. That is, one channel is prepared for the sound generating channel for the singing sound, and two singing sounds can not be generated simultaneously. Therefore, when the next key-on n3 is detected at the time t4 before the time t5 at which the key of the key-on n2 is keyed off (that is, in the case of the legato), the sound generation of the singing sound based on the key-on n2 is stopped at the time t4, so that the sound generation of the singing sound based on key-on n3 is started from time t4.

Therefore, the sound source 13 selects the speech element data "u-y", "y-o", and "o" for generating "yo" which is syllable c3 (step S12), and from time t4, speech element data of '"u-y"→"y-o"→"o"' is generated at the pitch of D5 and the sustain volume of the envelope ENV2 (step S13). As a result, singing sounds are smoothly connected from "ru" to "yo" and generated. Even if the key of the key-on n2 is keyed off at the time t5, since the sound generation of the singing sound based on the key-on n2 has already been stopped, none of the processing is performed.

When the CPU 10 detects that the key-on n3 is keyed off at time t6, it starts the key-off process shown in FIG. 5. The third syllable c3 "yo" is not grouped. Therefore, in step S30 of the key-off process, the CPU 10 determines that the key-off sound generation flag is not set (No in step S30), and the process proceeds to step S34. In step S34, the sound source 13 performs mute processing, and the sound generation of the singing sound of "yo" is stopped. That is, the singing sound of "yo" is muted in the release curve of the envelope ENV2. Upon completion of the process of step S34, the key-off process is terminated.

When the performance operator 16 is operated as the real-time performance progresses and the fourth key-on n4 is detected, the above-described key-on process is restarted, and the key-on process described above is performed. The sound generation instruction acceptance processing of step S10 in the fourth key-on process will be described. In this process, when accepting a sound generation instruction based on the fourth key-on n4 of the operated performance operator 16, the CPU 10 receives the timing of the key-on n4, the pitch information indicating the pitch of E5, and the velocity information corresponding to the key velocity. In the syllable information acquisition processing of step S11, the CPU 10 reads out from the data memory 18, "ko" which is the fourth syllable c41 on which the cursor of the designated lyrics is placed (step S20). The grouping information 31 of the acquired syllable "ko" is "o". Therefore, the CPU 10 determines that the syllable c41 is grouped with another syllable (step S21), and the process proceeds to step S22. In step S22, syllables belonging to the same group (syllables in the group) are acquired. In this case, since "ko" and "i" are grouped, the CPU 10 reads out from the data memory 18, the syllable c42 "i" which is a syllable belonging to the same group as the syllable c41. Next, the CPU 10 sets the key-off sound generation flag in step S23, and prepares to generate the next syllable "i" belonging to the same group when key-off is made. In the next step S24, for the text data 30, the CPU 10 advances the cursor to the next syllable beyond the group to which "ko" and "i" belong. However, in the case of the illustrated example, since there is no next syllable, this process is skipped. Upon completion of the process of step S24, the syllable information acquisition processing is terminated, and the process returns to step S12 of the key-on process.

In the speech element data selection processing of step S12, the sound source 13 selects speech element data corresponding to the syllables "ko" and "i" belonging to the same group. That is, the sound source 13 selects speech element data "#-k" corresponding to "silence→consonant k" and speech element data "k-o" corresponding to "syllable ko→vowel o" from phonemic chain data 32*a* and also selects speech element data "o" corresponding to "vowel o" from the stationary part data 32*b*, as speech element data corresponding to the syllable "ko". In addition, the sound source 13 selects the speech element data "o-i" corresponding to "vowel o→vowel i" from the phonemic chain data 32*a* and selects the speech element data "i" corresponding to "vowel i" from the stationary part data 32*b*, as speech element data corresponding to the syllable "i". In the sound generation processing of step S13, among the syllables belonging to the same group, sound generation of the first syllable is performed. That is, under the control of the CPU 10, the sound source 13 sequentially generates the speech element data of '"#-k"→"k-o"→"o"'. As a result, "ko" which is the syllable c41 is generated. At the time of sound generation, a singing sound of "ko" is generated with the volume corresponding to the velocity information, at the pitch of E5 received at the time of accepting the sound generation instruction of key-on n4. When the sound generation processing of step S13 is completed, the key-on process is also terminated.

FIG. 4 shows the operation of this key-on process. At time t7, the CPU 10 accepts the sound generation instruction of the fourth key-on n4 (step S10). The CPU 10 acquires the fourth syllable c41 (and the grouping information 31 embedded in or associated with the syllable c41). The CPU 10 determines that the syllable c41 is grouped with another syllable based on the grouping information 31. The CPU 10 obtains the syllable c42 belonging to the same group as the syllable c41 and sets the key-off sound generation flag (step S11). Next, the sound source 13 selects the speech element data "#-k", "k-o", "o" and the speech element data "o-i", "i" for generating the syllables c41 and c42 (Step S12). Then, the sound source 13 starts the envelope ENV3 of the volume corresponding to the velocity information of the key-on n4, and generates sound of the speech element data of '"#-k"→"k-o"→"o"' at the pitch of E5 and the volume of the envelope ENV3 (step S13). As a result, a singing sound of"ko" is generated. The envelope ENV3 is the same as the envelope ENV1. The speech element data "o" is repeatedly reproduced until the key corresponding to the key-on n4 is keyed off at time t8. Then, when the CPU 10 detects that the key-on n4 is keyed off at time t8, the CPU 10 starts the key-off process shown in FIG. 5.

"ko" and "i" which are the syllables c41 and c42 are grouped, and the key-off sound generation flag is set. Therefore, in step S30 of the key-off process, the CPU 10 determines that the key-off sound generation flag is set (Yes in step S30), and the process proceeds to step S31. In step S31, sound generation processing of the next syllable belonging to the same group as the syllable previously generated is performed. That is, in the syllable information acquisition processing of step S12 performed earlier, the sound source 13 generates sound of the speech element data of '"o-i"→"i"' selected as the speech element data corresponding to the syllable "i", with the pitch of E5 and the volume of the release curve of the envelope ENV3. As a result, a singing sound of "i" which is a syllable c42 is generated at the same pitch E5 as "ko" of c41. Next, in step S32, mute processing is performed, and the sound generation of the singing sound "i" is stopped. That is, the singing sound of "i" is being muted in the release curve of the envelope ENV3. The sound generation of"ko" is stopped at the point of time when the sound generation shifts to "i". Then, in step S33, the key-off sound generation flag is reset and key-off processing is terminated.

As described above, in the sound generating apparatus 1 of the first embodiment, a singing sound, which is a singing sound corresponding to a real-time performance of a user, is generated, and a key is pressed once in real time playing (that is, performing one continuous operation from pressing to releasing the key; the same hereinafter), so that it is possible to generate a plurality of singing sounds. That is, in the sound generating apparatus 1 of the first embodiment, the grouped syllables are a set of syllables that are generated by pressing the key once. For example, grouped syllables of c41 and c42 are generated by a single pressing operation. In this case, the sound of the first syllable is output in response to pressing the key, and the sound of the second syllable and thereafter is output in response to moving away from the key. Information on grouping is information for determining whether or not to sound the next syllable by key-off, so it can be said to be "key-off sound generation information (setting information)". The case where a key-on (referred to as key-on n5) associated with another key of the performance operator 16 is performed before the key associated with the key-on n4 is keyed off will be described. In this case, after the key-off process of the key-on n4 is performed, the key-on n5 sound is generated. That is, after syllable c42 is generated as the key-off process of key-on n4, the next syllable to c42 corresponding to key-on n5 is generated. Alternatively, in order to instantly generate a syllable corresponding to key-on n5, the process of step S31 may be omitted in the key-off process of key-on n4 that is executed in response to operation of key-on n5. In this case, the syllable of c42 is not generated, so that generation of the next syllable to c42 will be performed immediately according to key-on n5.

Figure 6A:
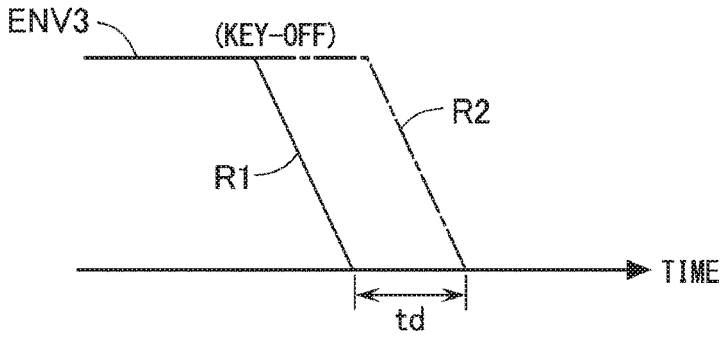
FIG. 6A is a view for explaining another operation example of the key-off process executed by the sound generating apparatus according to the first embodiment of the present invention.
Figure 6B:
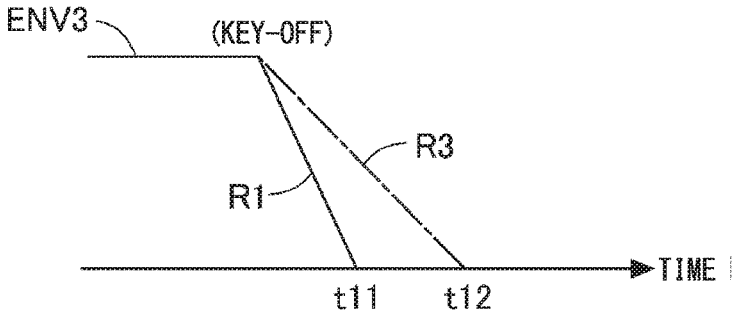
FIG. 6B is a view for explaining another operation example of the key-off process executed by the sound generating apparatus according to the first embodiment of the present invention.
Figure 6C:
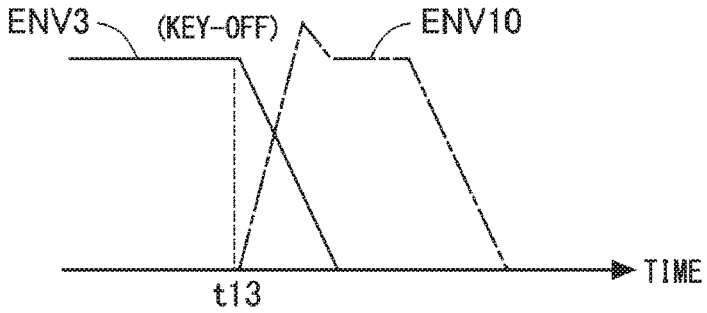
FIG. 6C is a view for explaining another operation example of the key-off process executed by the sound generating apparatus according to the first embodiment of the present invention.

As described above, the sound generation of "i" of the next syllable c42 belonging to the same group as the previous syllable c41 is generated at the timing when the key corresponding to the key-on n4 is keyed off. Therefore, there is a possibility that the sound generation length of the syllable instructed to be generated by key-off is too short and it becomes indistinct. FIGS. 6A to 6C show another example of the operation of the key-off process enabling to sufficiently lengthen the sound generation of the next syllable belonging to the same group.

In the example shown in FIG. 6A, the start of attenuation is delayed by a predetermined time td from the key-off in the envelope ENV3 which is started by the sound generation instruction of key-on n4. That is, by delaying the release curve R1 by the time td as in the release curve R2 indicated by the alternate long and short dashed line, it is possible to sufficiently lengthen the sound generation length of the next syllable belonging to the same group. By operation of the sustain pedal or the like, the sound generation length of the next syllable belonging to the same group can be made sufficiently long. That is, in the example shown in FIG. 6A, the sound source 13 outputs the sound of the syllable c41 at a constant sound volume in the latter half of the envelope ENV3. Next, the sound source 13 causes the output of the sound of the syllable c42 to be started in continuation from the stop of the output of the sound of the syllable c41. At that time, the volume of the sound of the syllable c42 is the same as the volume of the syllable c41 just before the sound is muted. After maintaining the volume for the predetermined time td, the sound source 13 starts lowering the volume of the sound of the syllable c42.

In the example shown in FIG. 6B, attenuation is made slowly in the envelope ENV3. That is, by generating the release curve R3 shown by a one-dot chain line with a gentle slope, it is possible to sufficiently lengthen the sound generation length of the next syllable belonging to the same group. That is, in the example shown in FIG. 6B, the sound source 13 outputs the sound of the syllable c42 while reducing the volume of the sound of the syllable c42, at an attenuation rate slower than the attenuation rate of the volume of the sound of the syllable c41 in the case where the sound of the syllable c42 is not output (the case where the syllable c41 is not grouped with other syllables).

In the example shown in FIG. 6C, the key-off is regarded as a new note-on instruction, and the next syllable is generated with a new note having the same pitch. That is, the envelope ENV10 is started at time t13 of key-off, and the next syllable belonging to the same group is generated. This makes it possible to sufficiently lengthen the sound generation length of the next syllable belonging to the same group. That is, in the example shown in FIG. 6C, the sound source 13 starts to lower the volume of the sound of the syllable c41 and simultaneously starts outputting the sound of the syllable c42. At this time, the sound source 13 outputs the sound of the syllable c42 while increasing the sound volume of the sound of the syllable c42.

In the sound generating apparatus 1 of the first embodiment of the present invention described above, the case where the lyrics are Japanese is illustrated. In Japanese, almost always one character is one syllable. On the other hand, in other languages, one character often does not become one syllable. As a specific example, the case where the English lyrics are "september" will be explained. "september" is composed of three syllables "sep", "tem", and "ber". Therefore, each time the user presses the key of the performance operator 16, the three syllables are sequentially generated at the pitch of the key. In this case, by grouping the two syllables "sep" and "tem", two syllables "sep" and "tem" are generated according to the operation of pressing the key once. That is, in response to an operation of pressing a key, a sound of a syllable of "sep" is output with the pitch of that key. Also, according to the operation of moving away from the key, the syllable of "tem" is generated with the pitch of that key. The lyrics are not limited to Japanese and may be other languages.

Figure 7:
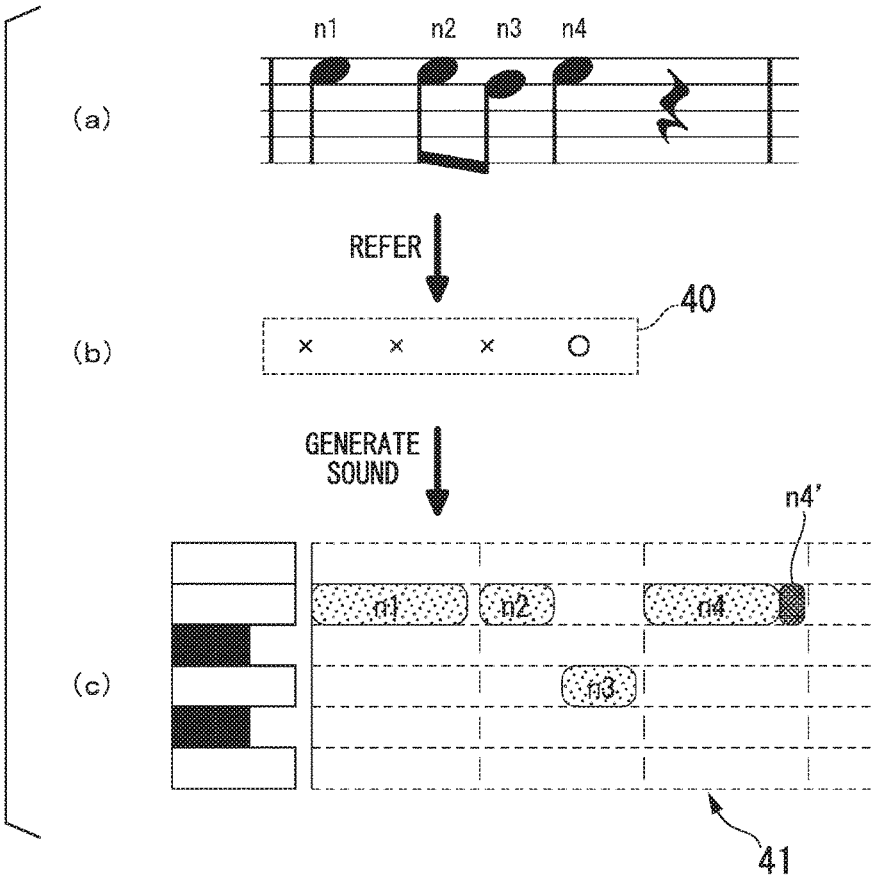
FIG. 7 is a view for explaining an operation example of a sound generating apparatus according to a second embodiment of the present invention.

Next, a sound generating apparatus according to a second embodiment of the present invention will be described. The sound generating apparatus of the second embodiment generates a predetermined sound without lyrics such as: a singing sound such as a humming sound, scat or chorus; or a sound effect such as an ordinary instrument sound, bird's chirp or telephone bell. The sound generating apparatus of the second embodiment will be referred to as a sound generating apparatus 100. The structure of the sound generating apparatus 100 of the second embodiment is almost the same as that of the sound generating apparatus 1 of the first embodiment. However, in the second embodiment, the configuration of the sound source 13 is different from that of the first embodiment. That is, the sound source 13 of the second embodiment has a predetermined sound timbre without the lyrics described above, and can generate a predetermined sound without lyrics according to the designated timbre. FIG. 7 is a diagram for explaining an operation example of the sound generating apparatus 100 of the second embodiment.

In the sound generating apparatus 100 of the second embodiment, the key-off sound generation information 40 is stored in the data memory 18 in place of the syllable information including the text data 30 and the grouping information 31. Further, the sound generating apparatus 100 of the second embodiment causes a predetermined sound without lyrics to be generated when the user performs the real-time performance using the performance operator 16. In the sound generating apparatus 100 of the second embodiment, in step S11 of the key-on process shown in FIG. 2A, key-off sound information processing is performed in place of the syllable information acquisition processing shown in FIG. 2B. In addition, in the speech element data selection processing of step S12, a sound source waveform or speech element data for generating a predetermined sound or voice is selected. The operation will be described below.

When the CPU 10 detects that the performance operator 16 is keyed on by the user performing in real-time, the CPU 10 starts the key-on process shown in FIG. 2A. A case where the user plays the music of the musical score shown in part (a) of FIG. 7 will be described. In this case, the CPU 10 accepts the sound generation instruction of the first key-on n1 in step S10 and receives the pitch information indicating the pitch of E5 and the velocity information corresponding to the key velocity. Then, the CPU 10 refers to the key-off sound generation information 40 shown in part (b) of FIG. 7 and obtains key-off sound generation information corresponding to the first key-on n1. In this case, specific key-off sound generation information 40 is designated prior to the performance by the user. This specific key-off sound generation information 40 corresponds to the musical score shown in part (a) of FIG. 7 and is stored in the data memory 18. Also, the first key-off sound generation information of the designated key-off sound generation information 40 is referred to. Since the first key-off sound generation information is set to "x", the key-off sound generation flag is not set for key-on n1. Next, in step S12, the sound source 13 performs the speech element data selection processing. That is, the sound source 13 selects speech element data that causes a predetermined voice to be generated. As a specific example, a case where the voice of "na" is generated will be described. In the following, "na" indicates one letter of Japanese katakana. The sound source 13 selects speech element data "#-n" and "n-a" from the phonemic chain data 32*a*, and selects speech element data "a" from the stationary part data 32*b*. Then, in step S13, sound generation processing corresponding to key-on n1 is performed. In this sound generation processing, as indicated by the piano roll score 41 shown in part (c) of FIG. 7, the sound source 13 generates sound of speech element data of "'#-n"→"n-a"→"a"', at the pitch of E5 received at the time of detection of the key-on n1. As a result, a singing sound of "na" is generated. This sound generation is continued until the key-on n1 is keyed off, and when it is keyed off, it is silenced and stopped.

When the key-on n2 is detected by the CPU 10 as the real-time performance progresses, the same processing as described above is performed. Since the second key-off sound generation information corresponding to key-on n2 is set to "x", the key-off sound generation flag for key-on n2 is not set. As shown in part (c) of FIG. 7, a predetermined sound, for example, a singing sound of "na" is generated at the pitch of E5. When the key-on n3 is detected before the key of key-on n2 is keyed off, the same processing as above is performed. Since the third key-off sound generation information corresponding to key-on n3 is set to "x", the key-off sound generation flag for key-on n3 is not set. As shown in part (c) of FIG. 7, a predetermined sound, for example, a singing sound of "na" is generated at the pitch of D5. In this case, the sound generation corresponding to the key-on n3 becomes a legato that smoothly connects to the sound corresponding to the key-on n2. Also, at the same time as the start of sound generation corresponding to key-on n3, sound generation corresponding to key-on n2 is stopped. Furthermore, when the key of key-on n3 is keyed off, the sound corresponding to key-on n3 is silenced and stopped.

When the key-on n4 is detected by the CPU 10 as further performance progresses, the same processing as described above is performed. Since the fourth key-off sound generation information corresponding to the key-on n4 is "○", the key-off sound generation flag for the key-on n4 is set. As shown in part (c) of FIG. 7, a predetermined sound, for example, a singing sound of "na" is generated at the pitch of E5. When the key-on n4 is keyed off, the sound corresponding to the key-on n2 is silenced and stopped. However, since the key-off sound generation flag is set, the CPU 10 judges that the key-on n4 'shown in part (c) of FIG. 7 is newly performed, and the sound source 13 performs the sound generation corresponding to the key-on n4', at the same pitch as the key-on n4. That is, a predetermined sound at the pitch of E5, for example, a singing sound of "na" is generated when the key of key-on n4 is keyed off. In this case, the sound generation length corresponding to the key-on n4' is a predetermined length.

In the sound generating apparatus 1 according to the first embodiment described above, when the user performs a real-time performance using the performance operator 16 such as a keyboard or the like, a syllable of the text data 30 is generated at the pitch of the performance operator 16, each time the operation of pressing the performance operator 16 is performed. The text data 30 is text data in which the designated lyrics are divided up into syllables. As a result, the designated lyrics are sung during the real-time performance. By grouping the syllables of the lyrics to be sung, it is possible to sound the first syllable and the second syllable at the pitch of the performance operator 16 by one continuous operation on the performance operator 16. That is, in response to pressing the performance operator 16, the first syllable is generated at the pitch corresponding to the performance operator 16. Also, in response to an operation of moving away from the performance operator 16, the second syllable is generated at the pitch corresponding to the performance operator 16.

In the sound generating apparatus 100 according to the second embodiment described above, a predetermined sound without the lyrics described above can be generated at the pitch of the pressed key instead of the singing sound made by the lyrics. Therefore, the sound generating apparatus 100 according to the second embodiment can be applied to karaoke guides and the like. Also in this case, respectively depending on the operation of pressing the performance operator 16 and the operation of moving away from the performance operator 16, which are included in one continuous operation on the performance operator 16, predetermined sounds without lyrics can be generated.

Figure 8:
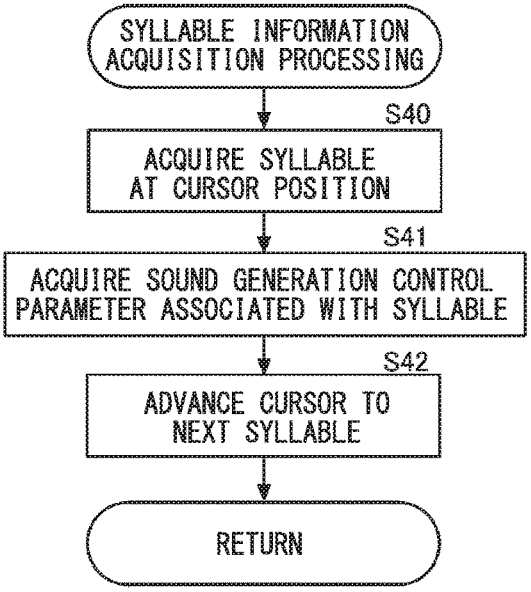
FIG. 8 is a flowchart of syllable information acquisition processing executed by a sound generating apparatus according to a third embodiment of the present invention.
Figures 9A, 9B:
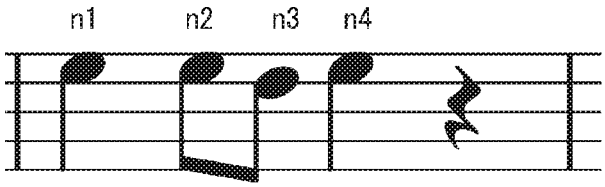
FIG. 9A is a diagram for explaining sound generation instruction acceptance processing executed by the sound generating apparatus according to the third embodiment of the present invention.
FIG. 9B is a diagram for explaining syllable information acquisition processing executed by the sound generating apparatus according to the third embodiment of the present invention.
Figure 10:
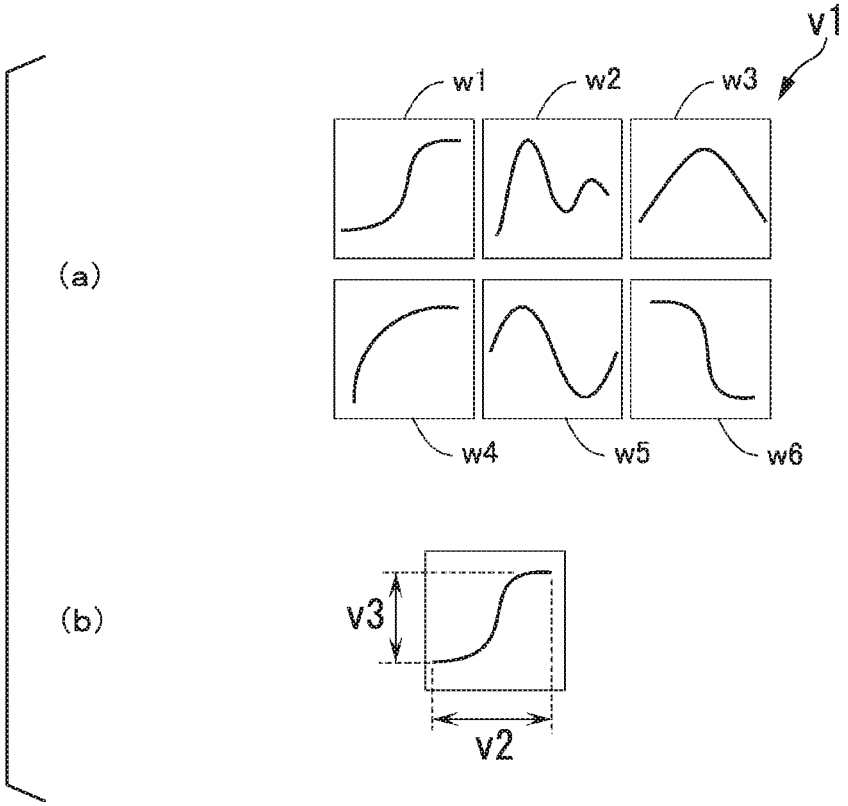
FIG. 10 is a diagram showing values of a lyrics information table in the sound generating apparatus according to the third embodiment of the present invention.
Figure 11:
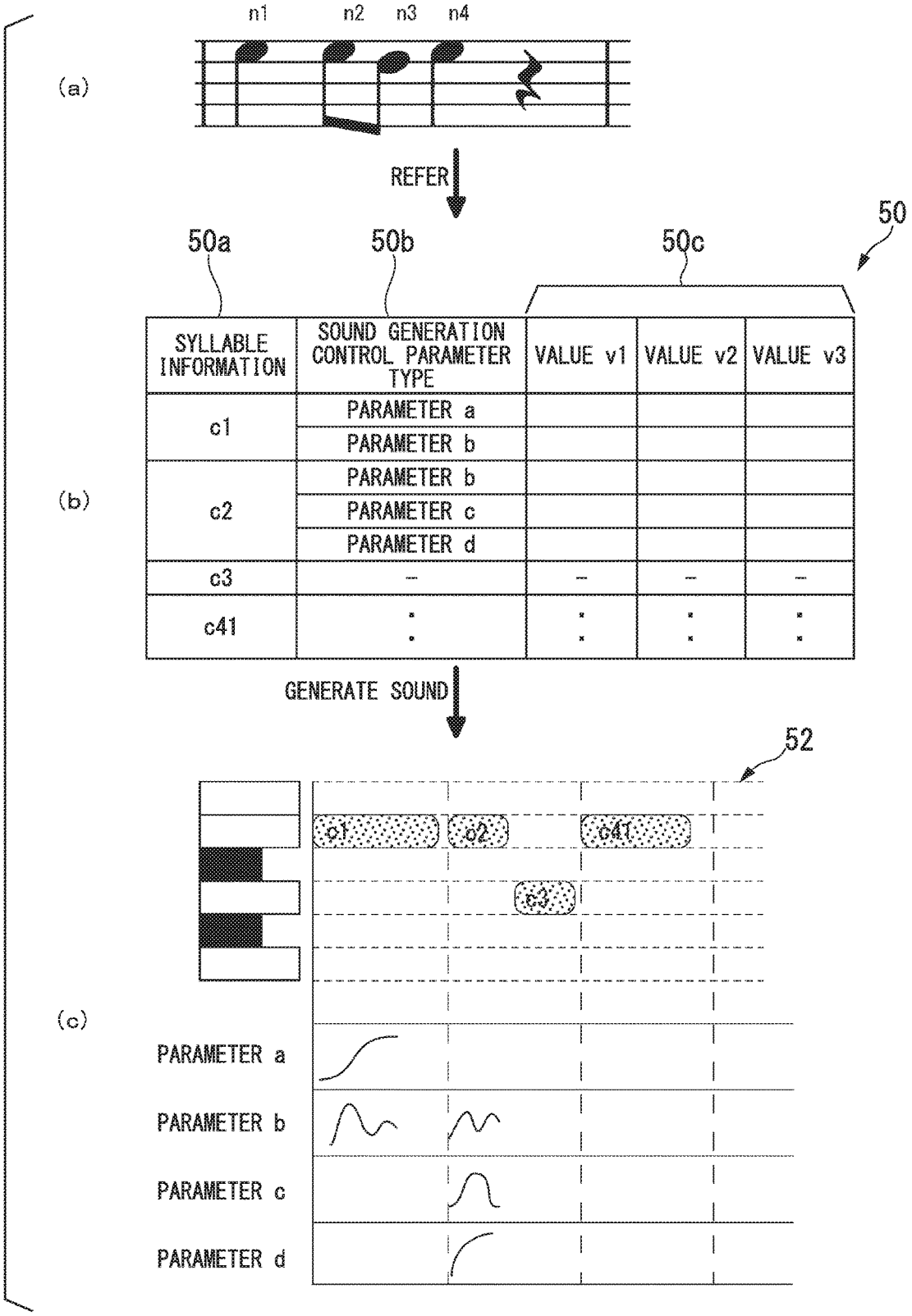
FIG. 11 is a diagram illustrating an operation example of the sound generating apparatus according to the third embodiment of the present invention.

Next, a sound generating apparatus 200 according to a third embodiment of the present invention will be described. In the sound generating apparatus 200 of the third embodiment, when a user performs real-time performance using the performance operator 16 such as a keyboard, it is possible to perform expressive singing sounds. The hardware configuration of the sound generating apparatus 200 of the third embodiment is the same as that shown in FIG. 1. In the third embodiment, as in the first embodiment, the key-on process shown in FIG. 2A is executed. However, in the third embodiment, the content of the syllable information acquisition processing in step S11 in this key-on process is different from that in the first embodiment. Specifically, in the third embodiment, the flowchart shown in FIG. 8 is executed as the syllable information acquisition processing in step S11. FIG. 9A is a diagram for explaining sound generation instruction acceptance processing executed by the sound generating apparatus 200 of the third embodiment. FIG. 9B is a diagram for explaining the syllable information acquisition processing executed by the sound generating apparatus 200 of the third embodiment. FIG. 10 shows "value v1" to "value v3" of a lyrics information table. FIG. 11 shows an operation example of the sound generating apparatus 200 of the third embodiment. The sound generating apparatus 200 of the third embodiment will be described with reference to these figures.

In the sound generating apparatus 200 of the third embodiment, when the user performs real-time performance, the performance is performed by operating the performance operator 16. The performance operator 16 is a keyboard or the like. When the CPU 10 detects that the performance operator 16 is keyed on as the performance progresses, the key-on process shown in FIG. 2A is started. The CPU 10 executes the sound generation instruction acceptance processing of step S10 of the key-on process, and the syllable information acquisition processing of step S11. The sound source 13 executes the speech element data selection processing of step S12, and the sound generation processing of step S13, under the control of the CPU 10.

In step S10 of the key-on process, a sound generation instruction based on the key-on of the operated performance operator 16 is accepted. In this case, the CPU 10 receives performance information such as key-on timing, tone pitch information of the operated performance operator 16, and velocity. In the case where the user plays the music as shown in the musical score shown in FIG. 9A, when accepting the timing of the first key-on n1, the CPU 10 receives the pitch information indicating the tone pitch of E5, and the velocity information corresponding to the key velocity. Next, in step S11, syllable information acquisition processing for acquiring syllable information corresponding to key-on n1 is performed. FIG. 8 shows a flowchart of this syllable information acquisition processing. When the syllable information acquisition processing shown in FIG. 8 is started, the CPU 10 acquires the syllable at the cursor position in step S40. In this case, the lyrics information table 50 is specified prior to the user's performance. The lyrics information table 50 is stored in the data memory 18. The lyrics information table 50 contains text data in which lyrics corresponding to musical scores corresponding to the performance are divided up into syllables. These lyrics are the lyrics corresponding to the score shown in FIG. 9A. Further, the cursor is placed at the head syllable of the text data of the designated lyrics information table 50. Next, in step S41, the CPU 10 refers to the lyrics information table 50 to acquire the sound generation control parameter (an example of a control parameter) associated with the syllable of the acquired first text data, and obtains it. FIG. 9B shows the lyrics information table 50 corresponding to the musical score shown in FIG. 9A.

In the sound generating apparatus 200 of the third embodiment, the lyrics information table 50 has a characteristic configuration. As shown in FIG. 9B, the lyrics information table 50 is composed of syllable information 50*a*, sound generation control parameter type 50*b*, and value information 50*c* of the sound generation control parameter. The syllable information 50*a* includes text data in which lyrics are divided up into syllables. The sound generation control parameter type 50*b* designates one of various parameter types. The sound generation control parameter includes a sound generation control parameter type 50*b* and value information 50*c* of the sound generation control parameter. In the example shown in FIG. 9B, the syllable information 50*a* is composed of syllables delimited by the lyrics c1, c2, c3, c41 similar to the text data 30 shown in FIG. 3B. As the sound generation control parameter type 50*b*, one or more of the parameters a, b, c, and d are set for each syllable. Specific examples of this type of sound generation control parameter type are "Harmonics", "Brightness", "Resonance", and "GenderFactor". "Harmonics" is a parameter of a type that changes the balance of harmonic overtone components included in a voice. "Brightness" is a parameter of a type that gives a tone change by rendering the contrast of the voice. "Resonance" is a parameter of a type that renders the timbre and intensity of voiced sounds. "GenderFactor" is a parameter of a type that changes the thickness and texture of feminine or masculine voices by changing the formant. The value information 50*c* is information for setting the value of the sound generation control parameter, and includes "value v1", "value v2", and "value v3". "value v1" sets how the sound generation control parameter changes over time and can be expressed in a graph shape (waveform). Part (a) of FIG. 10 shows an example of "value v1" represented by a graph shape. Part (a) of FIG. 10 shows graph shapes w1 to w6 as "value v1". The graph shapes w1 to w6 each have different changes over time. "value v1" is not limited to graph shapes w1 to w6. As the "value v1", it is possible to set a graph shape (value) which changes over various times. "value v2" is a value for setting the time on the horizontal axis of "value v1" indicated by the graph shape as shown in part (b) of FIG. 10. By setting "value v2", it is possible to set the speed of change that becomes the time from the start of the effect to the end of the effect. "value v3" is a value for setting the amplitude of the vertical axis of "value v1" indicated by the graph shape as shown in part (b) of FIG. 10. By setting "value v3", it is possible to set the depth of change indicating the degree of effectiveness. The settable range of the value of the sound generation control parameter set by the value information 50*c* is different depending on the sound generation control parameter type. Here, the syllable designated by the syllable information 50*a* may include a syllable for which the sound generation control parameter type 50*b* and its value information 50*c* are not set. For example, the syllable c3 shown in FIG. 11 does not have the sound generation control parameter type 50*b* and its value information 50*c* set. The syllable information 50*a*, the sound generation control parameter type 50*b*, and the value information 50*c* in the lyrics information table 50 are created and/or edited prior to the performance of the user, and are stored in the data memory 18.

Description returns to step S41. When the first key-on is n1, the CPU 10 acquires the syllable of c1 in step S40. Therefore, in step S41, the CPU 10 acquires the sound generation control parameter type and the value information 50*c* associated with the syllable c1 from the lyrics information table 50. In other words, the CPU 10 acquires the parameter a and the parameter b set in the horizontal row of c1 of the syllable information 50*a*, as the sound generation control parameter type 50*b*, and acquires "value v1" to "value v3" for which illustration of detailed information is omitted, as value information 50*c*. Upon completion of the process of step S41, the process proceeds to step S42. In step S42, the CPU advances the cursor to the next syllable of the text data, whereby the cursor is placed on c2 of the second syllable. Upon completion of the process of step S42, the syllable information acquisition processing is terminated, and the process returns to step S12 of the key-on process. In the syllable information acquisition processing of step S12, as described above, speech element data for generating the acquired syllable c1 is selected from the phoneme database 32. Next, in the sound generation processing of step S13, the sound source 13 sequentially generates sounds of the selected speech element data. As a result, syllables of c1 are generated. At the time of sound generation, a singing sound of syllable c1 is generated at the pitch of E5 with a volume corresponding to velocity information received at the time of reception of key-on n1. When the sound generation processing of step S13 is completed, the key-on process is also terminated.

Part (c) of FIG. 11 shows the piano roll score 52. In the sound generation process of step S13, as shown in the piano roll score 52, the sound source 13 generates the selected speech element data with the pitch of E5 received at the time of detection of key-on n1. As a result, the singing sound of the syllable c1 is generated. At the time of this sound generation, the sound generation control of the singing sound is performed by two sound generation control parameter types of the parameter "a" set with "value v1", "value v2", and "value v3", and the parameter "b" set with "value v1", "value v2", and "value v3", that is, two different modes. Therefore, it is possible to make a change to the expression and intonation, and the voice quality and the timbre of the singing sound to be sung, so that fine nuances and intonation are attached to the singing sound.

Then, when the CPU 10 detects the key-on n2 as the real-time performance progresses, the same process as described above is performed, and the second syllable c2 corresponding to the key-on n2 is generated at the pitch of E5. As shown in part (b) of FIG. 9, three sound generation control parameter types of parameter b, parameter c, and parameter d are associated with syllable c2 as sound generation control parameter type 50*b*, and each sound generation control parameter type is set with respective "value v1", "value v2", and "value v3". Therefore, when syllable c2 is generated, as shown in piano roll score 52 in part (c) of FIG. 11, three sound generation control parameter types having different parameters b, c, and d are used to perform sound generation control of the singing sound. This gives changes to the expression and intonation, and the voice quality and the timbre of the singing sound to be sung.

When the key 10 is detected by the CPU 10 as the real-time performance progresses, the same processing as described above is performed, and the third syllable c3 corresponding to the key-on n3 is generated at the pitch D5. As shown in FIG. 9B, syllable c3 has no sound generation control parameter type 50*b* set. For this reason, when syllable c3 is generated, as shown in the piano roll score 52 in part (c) of FIG. 11, sound generation control of the singing sound by the sound generation control parameter is not performed.

When the CPU 10 detects the key-on n4 as the real-time performance progresses, the same processing as described above is performed, and the fourth syllable c41 corresponding to the key-on n4 is generated at the pitch of E5. As shown in FIG. 9B, when syllable c41 is generated, sound generation control is performed according to the sound generation control parameter type 50*b* (not shown) and the value information 50*c* (not shown) associated with syllable c41.

In the sound generating apparatus 200 according to the third embodiment described above, when the user performs the real-time performance using the performance operator 16 such as a keyboard or the like, each time the operation of pressing the performance operator 16 is performed, the syllable of the designated text data is generated at the pitch of the performance operator 16. A singing sound is generated by using text data as lyrics. At this time, sound generation control is performed by sound generation control parameters associated with each syllable. As a result, it is possible to make a change to the expression and intonation, and the voice quality and the timbre of the singing sound to be sung, so that fine nuances and intonation are attached to the singing sound.

Explanation will be given for the case where the syllable information 50*a* of the lyrics information table 50 in the sound generating apparatus 200 according to the third embodiment is composed of the text data 30 of syllables delimited by lyrics, and its grouping information 31, as shown in FIG. 3B. In this case, it is possible to sound the grouped syllables at the pitch of the performance operator 16 by one continuous operation on the performance operator 16. That is, in response to pressing the performance operator 16, the first syllable is generated at the pitch of the performance operator 16. In addition, the second syllable is generated at the pitch of the performance operator 16 in accordance with the operation of moving away from the performance operator 16. At this time, sound generation control is performed by sound generation control parameters associated with each syllable. For this reason, it is possible to make a change to the expression and intonation, and the voice quality and the timbre of the singing sound to be sung, so that fine nuances and intonation are attached to the singing sound.

The sound generating apparatus 200 of the third embodiment can generate a predetermined sound without lyrics mentioned above which are generated by the sound generating apparatus 100 of the second embodiment. In the case of generating the abovementioned predetermined sound without lyrics by the sound generating apparatus 200 of the third embodiment, instead of determining the sound generation control parameter to be acquired in accordance with the syllable information, the sound generation control parameter to be acquired may be determined according to number of key pressing operations.

In the third embodiment, the pitch is specified according to the operated performance operator 16 (pressed key). Alternatively, the pitch may be specified according to the order in which the performance operator 16 is operated.

A first modified example of the third embodiment will be described. In this modified example, the data memory 18 stores the lyrics information table 50 shown in FIG. 12. The lyrics information table 50 includes a plurality of pieces of control parameter information (an example of control parameters), that is, first to nth control parameter information. For example, the first control parameter information includes a combination of the parameter "a" and the values v1 to v3, and a combination of the parameter "b" and the values v1 to v3. The plurality of pieces of control parameter information are respectively associated with different orders. For example, the first control parameter information is associated with a first order. The second control parameter information is associated with a second order. When detecting the first (first time) key-on, the CPU 10 reads the first control parameter information associated with the first order from the lyrics information table 50. The sound source 13 outputs sound in a mode according to the read out first control parameter information. Similarly, when detecting the key of the nth (nth time) key-on, the CPU 10 reads the sound generation control parameter information associated with the nth control parameter information associated with the nth order, from the lyric information table 50. The sound source 13 outputs a sound in a mode according to the read out nth control parameter information.

A second modification of the third embodiment will be described. In this modified example, the data memory 18 stores the lyrics information table 50 shown in FIG. 13. The lyrics information table 50 includes a plurality of pieces of control parameter information. The plurality of pieces of control parameter information are respectively associated with different pitches. For example, the first control parameter information is associated with the pitch A5. The second control parameter information is associated with the pitch B5. When detecting the key on of the key corresponding to the pitch A5, the CPU 10 reads out the first parameter information associated with the pitch A5, from the data memory 18. The sound source 13 outputs a sound at a pitch A5 in a mode according to the read out first control parameter information. Similarly, when detecting the key-on of the key corresponding to the pitch B5, the CPU 10 reads out the second control parameter information associated with the pitch B5, from the data memory 18. The sound source 13 outputs a sound at a pitch B5 in a mode according to the read out second control parameter information.

Figures 14, 15:
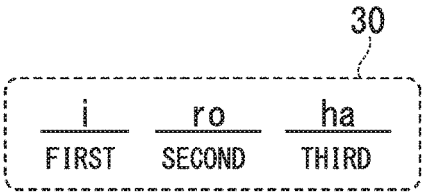
FIG. 14 is a diagram showing a modified example of text data according to the third embodiment of the present invention.
FIG. 15 is a diagram showing a modified example of the lyrics information table according to the third embodiment of the present invention.

A third modified example of the third embodiment will be described. In this modified example, the data memory 18 stores the text data 30 shown in FIG. 14. The text data 30 includes a plurality of syllables, that is, a first syllable "i", a second syllable "ro", and a third syllable "ha". In the following, "i", "ro", and "ha" each indicate one letter of Japanese hiragana, which is an example of a syllable. The first syllable "i" is associated with the first order. The second syllable "ro" is associated with the second order. The third syllable "ha" is associated with the third order. The data memory 18 further stores the lyrics information table 50 shown in FIG. 15. The lyrics information table 50 includes a plurality of pieces of control parameter information. The plurality of pieces of control parameter information are associated with different syllables, respectively. For example, the second control parameter information is associated with the syllable "i". The twenty-sixth control parameter information (not shown) is associated with the syllable "ha". The 45th control parameter information is associated with "ro". When detecting the first (first time) key-on, the CPU 10 reads "i" associated with the first order, from the text data 30. Further, the CPU 10 reads the second control parameter information associated with "i", from the lyrics information table 50. The sound source 13 outputs a singing sound indicating "i" in a mode according to the read out second control parameter information. Similarly, when detecting the second (second time) key-on, the CPU 10 reads out "ro" associated with the second order, from the text data 30. Further, the CPU 10 reads out the 45th control parameter information associated with "ro", from the lyrics information table 50. The sound source 13 outputs a singing sound indicating "ro" in a mode according to the 45th control parameter information.

Instead of the key-off sound generation information according to the embodiment of the present invention described above is included in the syllable information, it may be stored separately from the syllable information. In this case, the key-off sound generation information may be data describing how many times the key-off sound generation is executed when the key is pressed. The key-off sound generation information may be information generated by a user's instruction in real time at the time of performance. For example, only when a user steps on the pedal while the user is pressing the key, the key-off sound may be executed on that note. The key-off sound generation may be executed only when the time during which the key is pressed exceeds a predetermined length. Also, key-off sound generation may be executed when the key pressing velocity exceeds a predetermined value.

The sound generating apparatuses according to the embodiments of the present invention described above can generate a singing sound with lyrics or without lyrics, and can generate a predetermined sound without lyrics such as an instrument sound or a sound effect sound. In addition, the sound generating apparatuses according to the embodiments of the present invention can generate a predetermined sound including a singing sound.

When generating lyrics in the sound generating apparatuses according to the embodiments of the present invention explained above, explanation is made by taking Japanese as the example where the lyrics are almost always one syllable. However, the embodiments of the present invention are not limited to such a case. The lyrics of other languages in which one character does not become one syllable, may be delimited for each syllable, and the lyrics of other languages may be sung by generating the sound as described above with the sound generating apparatuses according to the embodiments of the present invention.

In addition, in the sound generating apparatuses according to the embodiments of the present invention described above, a performance data generating device may be prepared instead of the performance operator, and the performance information may be sequentially given from the performance data generating device to the sound generating apparatus.

Processing may be carried out by recording a program for realizing the functions of the singing sound generating apparatus 1, 100, 200 according to the above-described embodiments, in a computer readable recording medium, and reading the program recorded on this recording medium into a computer system, and executing the program.

The "computer system" referred to here may include hardware such as an operating system (OS) and peripheral devices.

The "computer-readable recording medium" may be a writable nonvolatile memory such as a flexible disk, a magneto-optical disk, a ROM (Read Only Memory), or a flash memory, a portable medium such as a DVD (Digital Versatile Disk), or a storage device such as a hard disk built into the computer system.

"Computer-readable recording medium" also includes a medium that holds programs for a certain period of time such as a volatile memory (for example, a DRAM (Dynamic Random Access Memory)) in a computer system serving as a server or a client when a program is transmitted via a network such as the Internet or a communication line such as a telephone line.

The above program may be transmitted from a computer system in which the program is stored in a storage device or the like, to another computer system via a transmission medium or by a transmission wave in a transmission medium. A "transmission medium" for transmitting a program means a medium having a function of transmitting information such as a network (communication network) such as the Internet and a telecommunication line (communication line) such as a telephone line.

The above program may be for realizing a part of the above-described functions.

The above program may be a so-called difference file (difference program) that can realize the above-described functions by a combination with a program already recorded in the computer system.

What is claimed is:

1. A sound control device comprising:

a processor configured to implement instructions stored in a memory and execute a plurality of tasks, including:

a reception task that receives a start instruction indicating a start of output of a sound;

a reading task that reads a first syllable and a control parameter that determines an output mode of the first syllable, in response to the reception task receiving the start instruction; and a control task that causes a singing sound indicating the first syllable to be output in a mode according to the read control parameter, wherein the reading task further reads a second syllable belonging to a same group as the first syllable in a case where the first syllable is to be grouped with another syllable based on grouping information indicating whether the first syllable is grouped with another syllable.

2. The sound control device according to claim 1, further comprising:

a storage device storing syllable information indicating the first syllable and the control parameter associated with the syllable information, wherein the reading task reads the syllable information and the control parameter from the storage device, and wherein the control task causes the singing sound to be output, in the mode according to the read control parameter.

3. The sound control device according to claim 2, wherein the control task causes the singing sound to be output in the mode according to the control parameter and at a certain pitch.

4. The sound control device according to claim 2, wherein the first syllable is represented by or corresponds to at least one character.

5. The sound control device according to claim 4, wherein the at least one character is Japanese kana.

6. The sound control device according to claim 1, further comprising:

a storage device storing a plurality of control parameters each respectively associated with one of a plurality of mutually different orders, wherein the receiving task sequentially receives a plurality of start instructions, including the start instruction, and wherein the reading task reads from the storage device a control parameter associated with an order in which the start instruction is received, among the plurality of control parameters.

7. The sound control device according to claim 1, further comprising:

a storage device storing a plurality of control parameters each respectively associated with one of a plurality of mutually different pitches, wherein the start instruction includes pitch information indicating a pitch among the plurality of mutually different pitches, wherein the reading task reads from the storage device, the control parameter, which is associated with the pitch among the plurality of control parameters, and wherein the control task causes the singing sound to be output in the mode according to the control parameter and at the pitch.

8. The sound control device according to claim 1, further comprising:

a plurality of operators each operable by a user and respectively associated with one of a plurality of mutually different pitches, wherein the reception task determines that the start instruction has been accepted when any one of the plurality of operators is operated by the user, and wherein the control unit causes the singing sound to be output in the mode according to the read control parameter and at a pitch associated with the any one operator among the plurality of mutually different pitches.

9. The sound control device according to claim 1, further comprising:

a storage device storing a plurality of control parameters each respectively associated with one of a plurality of mutually different syllables including the first and second syllables, wherein the reading task reads from the storage device, the control parameter, which is associated with the first syllable, among the plurality of control parameters.

10. The sound control device according to claim 1, further comprising:

a storage device storing a plurality of mutually different syllables including the first and second syllables, and a plurality of control parameters each respectively associated with one of the plurality of syllables, wherein the reading unit reads from the storage unit, as the control parameter, a control parameter associated with the first syllable among the plurality of control parameters.

11. The sound control device according to claim 1, wherein the control task causes the singing sound indicating the first syllable and a singing sound indicating the second syllable to be output at a certain pitch in a single envelope.

12. The sound control device according to claim 1, wherein the control tasks sufficiently lengthens sound generation of the second syllable.

13. The sound control device according to claim 12, wherein the control task causes the second syllable to be output at a second volume after causing the first syllable to be output at a first volume, the second volume being same as the first volume.

14. The sound control device according to claim 12, wherein the control task causes the second syllable to be output while reducing volume of the second syllable at a second attenuation rate, the second attenuation rate being slower than a first attenuation rate of volume of the first the syllable in a case where the second syllable is not output.

15. The sound control device according to claim 12, wherein the control task starts to lower volume of the first syllable and simultaneously starts to output the second syllable.

16. The sound control device according to claim 15, wherein control task causes the second syllable to be output while increasing volume of the second syllable.

17. A sound control method comprising the steps of:

receiving a start instruction indicating a start of output of a sound;

reading a first syllable and a control parameter that determines an output mode of the first syllable, in response to the start instruction being received causing singing sound indicating the first syllable to be output in a mode according to the read control parameter; and further reading a second syllable belonging to a same group as the first syllable, in a case where the first syllable is grouped with another syllable based on grouping information indicating whether the first syllable is grouped with another syllable.

18. A non-transitory computer-readable recording medium storing a sound control program that causes a computer to execute a method comprising the steps of:

receiving a start instruction indicating a start of output of a sound;

reading a first syllable and a control parameter that determines an output mode of the first syllable, in response to the start instruction being received causing singing sound indicating the first syllable to be output in a mode according to the read control parameter; and further reading a second syllable belonging to a same group as the first syllable, in a case where the first syllable is grouped with another syllable based on grouping information indicating whether the first syllable is grouped with another syllable.

* * * * *